US005689907A

United States Patent [19]

Cooley

[11] Patent Number: 5,689,907

[45] Date of Patent: Nov. 25, 1997

[54] INERT WEIGHTED MAGAZINE

[76] Inventor: Bennie W. Cooley, 3415 Rawson St., Idaho Falls, Id. 83406

[21] Appl. No.: 787,273

[22] Filed: Jan. 24, 1997

[51] Int. Cl.[6] ..... F41A 9/61

[52] U.S. Cl. ..... 42/50; 42/97; 42/1.01; 434/11; 434/24

[58] Field of Search ..... 42/50, 97, 6, 1.01, 42/7, 49.02; 434/11, 24

[56] References Cited

U.S. PATENT DOCUMENTS

| | | | |
|---|---|---|---|
| 119,357 | 9/1871 | Hobbs | 102/444 |
| 2,259,569 | 10/1941 | King | 42/1 |
| 2,322,212 | 6/1943 | Allen | 434/24 |
| 3,848,350 | 11/1974 | Seminiano | 42/1 N |
| 4,599,934 | 7/1986 | Palmer | 89/193 |

*Primary Examiner*—Charles T. Jordan
*Assistant Examiner*—Meena Chelliah
*Attorney, Agent, or Firm*—Hopkins Roden Crockett Hansen & Hoopes, PLLC

[57] ABSTRACT

An inert magazine for replacing a loaded magazine in a gun having a magazine chamber, the inert magazine includes a ballast, sized and shaped to be received into the magazine well of the gun, and means for removably retaining the ballast in the magazine well of the gun. The inert magazine is approximately the same weight as the weight of a loaded magazine for the gun. In a preferred embodiment, the ballast comprises a plastic shell filled with ballasting.

14 Claims, 1 Drawing Sheet

INERT WEIGHTED MAGAZINE

TECHNICAL FIELD

This invention relates to firearm technology and training and, more particularly, to an inert ammunition magazine for a gun which is weighted to simulate a loaded magazine.

BACKGROUND OF THE INVENTION

Accordingly, an object of the present invention is to provide an inert gun magazine which, when inserted in a magazine well, simulates the weight and feel of a loaded gun.

A typical semiautomatic .45 caliber pistol weighs about 2 to 2½ pounds unloaded. The magazine and the typical load of ten bullets will weigh about 10 ounces. Consequently, an empty pistol weighs only about 80% of a loaded pistol. In order to better simulate the feel of a loaded pistol during hand gun training or during dry fire clearing techniques, it is necessary to add this one-half pound to the pistol. As an option to adding this half pound of weight during gun training, the trainee could either put an empty magazine-clip in the gun or leave the clip out entirely. In the first case, an instructor or observer cannot tell if there is an empty or loaded magazine in the gun and the gun will not have the proper weight and balance. In the second case, the gun will be even lighter and will again have improper balance. It is the main purpose of this invention to prevent a live magazine from being placed in the firearm and having an accidental discharge while performing dry fire training and also to provide a simple color-coded set of inert magazines that fit in the various types of semiautomatic weapons, thereby providing a properly weighted, balanced and safe weapon.

SUMMARY OF THE INVENTION

According to principles of the present invention in a preferred embodiment, an inert magazine for replacing a loaded magazine in a gun comprises a ballast sized and shaped to be received into the magazine well of the gun and means for removably retaining the ballast in the magazine well of the gun. The ballast is approximately the same weight as the weight of a loaded magazine of a gun. In a preferred embodiment, the ballast comprises a shell filled with ballasting. According to further principles of the present invention, in a preferred embodiment, the means for removably retaining the ballast in the magazine well is a notch in a top front portion of the ballast whereby the notch is engaged by a well magazine catch, thereby retaining the ballast within the gun magazine well.

Other objects, advantages, and capabilities of the present invention will become more apparent as the description proceeds.

DETAILED DESCRIPTION OF THE INVENTION

Figure 1:
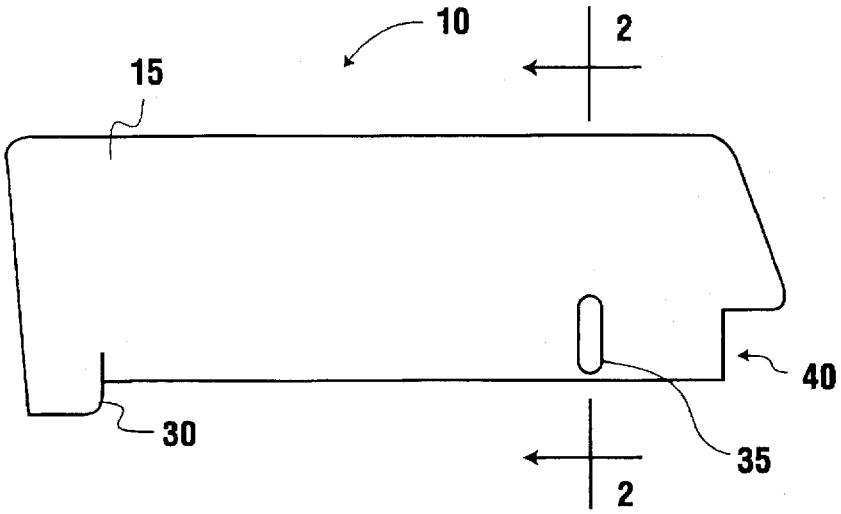
FIG. 1 is a side view showing the present invention inert ammunition magazine.
Figure 2:
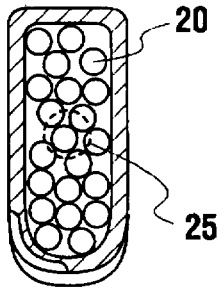
FIG. 2 is a section view of the magazine taken along lines 2—2 of FIG. 1.

FIGS. 1 and 2 show a preferred embodiment of the present invention ballast 10. The ballast 10 comprises an external shell 15, preferably formed of a hard plastic, and ballasting 20 which fills the shell. The shell is shaped so that it will fit into the magazine well of a gun and be retained in the well until removal is desired. As such, each type of gun will require an inert magazine of a different shape. Although the inert magazine has been described as a shell filled with ballasting, alternatively, the inert magazine can be formed to be a single piece of weighted ballasting.

The ballasting 20 such as lead shot or bismuth is loaded through an aperture 25 in the bottom section of shell 15. After loading the ballast 20, the aperture 25 is sealed, preferably with a hardening resin or thermoplastic ballasting.

The shape of shell 15 simulates the shape of a typical ammunition magazine. There is a necessary shoulder 30 at the base portion of the shell that acts as a "stop" during magazine insertion into the chamber and also provides a visible surface to a gun bearer, observer or gun instructor. Also, a necessary magazine catch notch 35 near a top front portion 40 of the shell is engaged by a magazine button activated catch in the gun handle. When the magazine button in the gun handle is depressed, the magazine can be extracted from the magazine well. There are some components in a normal gun magazine that are not necessary or duplicated in the inert magazine, i.e., the compression spring, follower, cartridge cavity and shell observation holes. Additionally, the preferred color for the inert magazine is blue. Blue is preferred because it is the international symbol for "inert."

The ballasting 20 is selected such that the combined weight of the shell 15 and the ballasting 20 will essentially equal the weight of a loaded magazine. The ballasting 20 may be any ballasting with a sufficient density so that the weight of the shell combined with the weight of the ballasting approximates the weight of a loaded magazine. Lead (S.G. of 11.4), bismuth (S.G. of 9.75), copper (S.G. of 8.9), iron (S.G. of 7.9), and tin (S.G. of 7.3) are examples of material with such a sufficient density. The weight of the inert magazine need not be exactly the same as that of the loaded magazine, the weights need only be close enough so that they will produce the same feel to a user of the gun.

Figure 5:
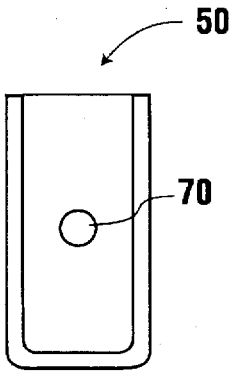
FIG. 5 is a bottom view of the alternate embodiment.
Figure 3:
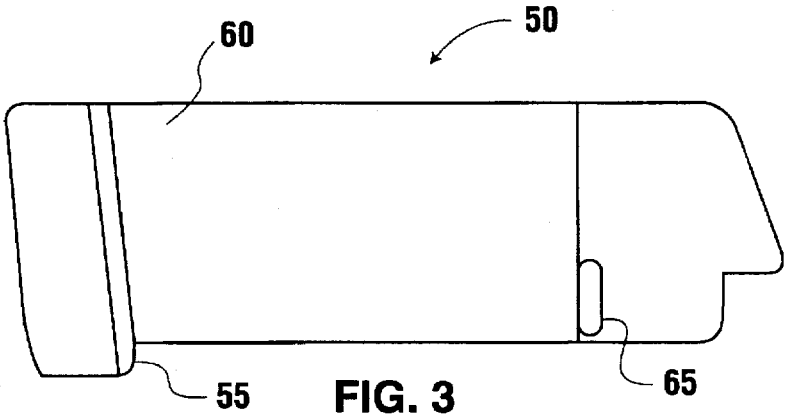
FIG. 3 is a side view of an alternate embodiment showing an inert magazine for a staggered box magazine style of gun.
Figure 4:
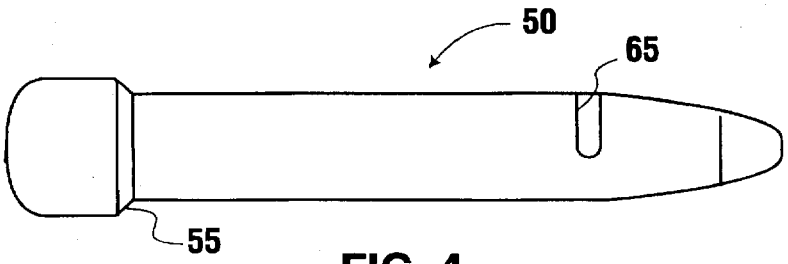
FIG. 4 is a front view of the alternate embodiment.

Referring now to FIG. 3–5, a larger staggered box magazine 50 is illustrated. In this magazine, the number of cartridges can be thirteen or greater and the loaded weight is about eleven ounces. In this case, the unloaded gun weight would be only 70% of the fully-loaded gun weight of about 3.2 pounds.

The staggered box magazine 50 has a shoulder 55 on three sides at a bottom portion of the shell 60 and again has the magazine catch notch 65 on the upper front portion of the shell. The aperture 70 is at the base and provides access to the shell 60 for the ballast 20.

Alternately, instead of filing the shell with a ballasting, the inert magazine is formed from a solid cast or machined material with sufficient density to approximate the loaded magazine. Aluminum is one example of a material with sufficient density. If the aluminum were used, the weight of the staggered box magazine would be approximately nine ounces, which is close to the previous ballasting weight of eleven ounces.

In summary, what has been described above are the preferred embodiments of an inert firearm magazine. While the present invention has been described by reference to specific embodiments, it will be obvious that other alternative embodiments may be employed without departing from the true spirit and scope of the invention.

What is claimed is:

1. An inert magazine for replacing a loaded magazine in a gun having a magazine well, the inert magazine comprising:

(a) a ballast sized and shaped to be received into the magazine well of the gun, the ballast weighing approximately the same as a weight of the loaded magazine of the gun; and, (b) means for removably retaining the ballast in the magazine well of the gun.

2. The inert magazine of claim 1 wherein the ballast comprises:

(a) ballasting; and, (b) a shell made of rigid durable material, the shell defining a cavity for receiving the ballasting.

3. The inert magazine of claim 2 wherein the ballasting is a combination of epoxy and a metal selected from the group consisting of lead, bismuth, copper, iron and tin.

4. The inert magazine of claim 2 wherein the shell is formed from a hard plastic.

5. The inert magazine of claim 2 wherein the ballasting essentially completely fills the cavity.

6. The inert magazine of claim 2 wherein the ballasting is lead, bismuth, copper, iron, or tin.

7. The inert magazine of claim 1 wherein the means for removably retaining the inert magazine in the gun comprises a notch in a front top portion of the ballast, the ballast having a notch shaped to receive a magazine catch of the gun, the notch aligned with the magazine catch when inserted into the magazine well, and wherein the magazine catch of the gun engaging the notch retains the ballast in the magazine well of the gun.

8. The inert magazine of claim 1 wherein the ballast is colored blue.

9. The inert magazine of claim 1 wherein the ballast is made from aluminum.

10. The inert magazine of claim 1 wherein the shell includes a bottom portion having an aperture formed therein, the aperture sized to receive the ballasting.

11. An inert magazine for replacing a loaded magazine in a gun having a magazine well, the inert magazine comprising:

(a) a heavy metal ballasting;

(b) a durable shell defining a cavity for receiving the ballasting, the shell sized and shaped to be received in the magazine well of the gun; and (c) a notch in a top front portion of the shell whereby the notch is aligned with and engaged by a gun magazine catch thereby retaining the ballast within the gun magazine well.

12. The inert magazine of claim 11 wherein the heavy metal ballasting is lead, bismuth, copper, iron or tin.

13. The inert magazine of claim 11 wherein the shell is blue plastic.

14. The inert magazine of claim 11 wherein the shell includes a bottom portion with an aperture formed therein, the aperture sized to receive the ballasting.

* * * * *